US008528237B1

(12) United States Patent
Bacall

(10) Patent No.: US 8,528,237 B1
(45) Date of Patent: Sep. 10, 2013

(54) SNOW PLOW

(76) Inventor: Paul Bacall, Brooklyn, NY (US)

( * ) Notice: Subject to any disclaimer, the term of this patent is extended or adjusted under 35 U.S.C. 154(b) by 393 days.

(21) Appl. No.: 13/032,901

(22) Filed: Feb. 23, 2011

(51) Int. Cl.
*E01H 5/04* (2006.01)

(52) U.S. Cl.
USPC ..... 37/231; 37/268

(58) Field of Classification Search
USPC ..... 37/231, 232, 236, 268, 468, 266, 37/269, 274–281; 172/272, 684.5, 799.5, 172/443, 444, 445.1
See application file for complete search history.

(56) References Cited

U.S. PATENT DOCUMENTS

| | | | | | |
|---|---|---|---|---|---|
| 3,800,447 | A * | 4/1974 | Harvey | 37/236 |
| 4,439,939 | A | 4/1984 | Blau | |
| 5,058,295 | A * | 10/1991 | Holland | 37/268 |
| 5,207,010 | A | 5/1993 | Grossman | |
| 5,930,922 | A * | 8/1999 | Altheide | 37/268 |
| 6,012,240 | A | 1/2000 | Klug et al. | |
| 6,484,421 | B1 | 11/2002 | Donoghue | |
| 6,516,544 | B1 | 2/2003 | Matisz et al. | |
| 6,874,260 | B2 | 4/2005 | Mullett | |
| 6,877,258 | B2 | 4/2005 | Frey | |
| 7,658,021 | B2 | 2/2010 | Schmeichel | |
| 7,676,963 | B2 | 3/2010 | Schmeichel | |
| 7,676,964 | B2 | 3/2010 | Schmeichel | |
| 7,963,052 | B2 * | 6/2011 | Koch et al. | 37/231 |
| 8,381,421 | B2 * | 2/2013 | Lhota et al. | 37/231 |
| 8,381,422 | B2 * | 2/2013 | Hill | 37/231 |

* cited by examiner

*Primary Examiner* — Robert Pezzuto
(74) *Attorney, Agent, or Firm* — Goldstein Law Offices, P.C.

(57) ABSTRACT

A snow plow for permanently attaching to a vehicle, selectively deploying a plow blade beyond a bumper and selectively retracting the blade underneath the vehicle by a hydraulic cylinder assembly. The snow plow has a pair of plow blades, namely a front plow blade and a rear plow blade that selectively deploy. The blades have side extensions that hydraulically extend laterally to remove the snow in front of the wheels and widen the path of snow removal. A hydraulic arm assembly pivots the blade to the right or to the left to attack the snow at an angle when plowing and removing snow. A pantographic frame assembly hydraulically lowers and raises the hydraulic cylinder assembly, lowering the plow blade closer to the ground or raising the blade higher for more ground clearance and decreasing the visibility of the blade and the hydraulic cylinder assembly underneath the vehicle.

18 Claims, 9 Drawing Sheets

SNOW PLOW

BACKGROUND OF THE INVENTION

The invention relates generally to a snow plow attached to a vehicle chassis. More particularly, the invention relates to a snow plow having a front and rear blade attached and stored underneath a vehicle that selectively deploys when needed to plow and remove snow.

Winter snows have always made travel difficult. Before there were motorized vehicles, horse-drawn wooden wedge plows cleared a passage for wagons and carriages to travel. Trains have plows attached to the frame of a front locomotive to remove snow from the tracks. Light rail transit systems have plows attached to the trams or end cars.

When roads must be cleared of snow, automobiles generally rely on other larger vehicles to clear the roadways for travel. Trucks, particularly large trucks such as garbage trucks and dump trucks, as well as other construction vehicles such as front loaders are the choice of most local governments. Typically, trucks are deployed with plows attached on an as-needed basis to the front end of the vehicle whenever snow removal is required. Trucks, particularly large trucks such as garbage trucks and dump trucks, as well as other construction vehicles such as front loaders are the choice of most local governments. These vehicles generally have sufficient front end clearance above ground, sufficient power and four-wheel drive trains to push a plow effectively.

Many automobile drivers want or need to plow their driveway or private road, particularly those who drive vehicles that have four-wheel or all wheel drive and have powerful engines. One has proposed a heavy cardboard assembly that folds flat or fold into a wedge-shaped blade that sticks onto the front of a vehicle. Drivers of sport utility vehicles (SUV) and light pickup trucks in particular have tried various solutions for attaching a plow to the front of a vehicle.

The most common way to attach a plow to a small vehicle is with a hitch and pin system. Many have proposed other attachment devices such as bungie cords, straps, belts and rings. Others focus on ways to adjust height and the angle of attack of the plow blade using hydraulic systems, booms, pulleys and cables. Improvements to the blades have also been suggested such as channels, side panels, angled side panels, ribbed blades, and rubber edges. A rear plow has also been proposed.

While these units may be suitable for the particular purpose employed, or for general use, they would not be as suitable for the purposes of the present invention as disclosed hereafter.

SUMMARY OF THE INVENTION

It is an object of the invention to produce a snow plow that is readily available when needed to plow snow. Accordingly, the invention is a snow plow that is permanently attached underneath a vehicle.

It is another object of the invention to produce a snow plow that is permanently attached to a vehicle, but is selectively deployed when needed to plow snow. Accordingly, the invention is a snow plow that selectively deploys beyond a bumper when needed and selectively retracts underneath of the vehicle.

It is a further object of the invention to produce a snow plow that plows snow when attached to a vehicle that is moving forward and backward. Accordingly, the invention is a snow plow having a pair of twin blades, one deploying on a vehicle front and one deploying on the vehicle rear.

It is yet another object of the invention to produce a snow plow that is attached to a vehicle, the snow plow removing the snow in front of the tires of the vehicle and clear a wide path. Accordingly, the invention is a snow plow with a blade having side extensions, the extensions plowing and removing the snow in front of the vehicle's tires as well as clearing a path wider than the width of the vehicle.

It is yet a further object of the invention to produce a snow plow that pivots the blade to the right or to the left. Accordingly, the snow plow has a hydraulic arm assembly that deploys and pivots the blade to the right or to the left when plowing and removing snow.

It is still a further object of the invention to produce a snow plow that stores invisibly underneath a vehicle. Accordingly, the snow plow has a pantographic hydraulic assembly that hydraulically lowers the plow blade closer to the ground and raises the blade higher for more ground clearance, and thereby decreasing the visibility of the blade underneath the vehicle.

The snow plow for permanently attaching to a vehicle, selectively deploying a plow blade beyond a bumper and selectively retracting the blade underneath the vehicle by a hydraulic cylinder assembly. The snow plow has a pair of plow blades, namely a front plow blade and a rear plow blade that selectively deploy. The blades have side extensions that hydraulically extend laterally to remove the snow in front of the wheels and widen the path of snow removal. A hydraulic arm assembly pivots the blade to the right or to the left to attack the snow at an angle when plowing and removing snow. A pantographic frame assembly hydraulically lowers and raises the hydraulic cylinder assembly, lowering the plow blade closer to the ground or raising the blade higher for more ground clearance and decreasing the visibility of the blade and the hydraulic cylinder assembly underneath the vehicle.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
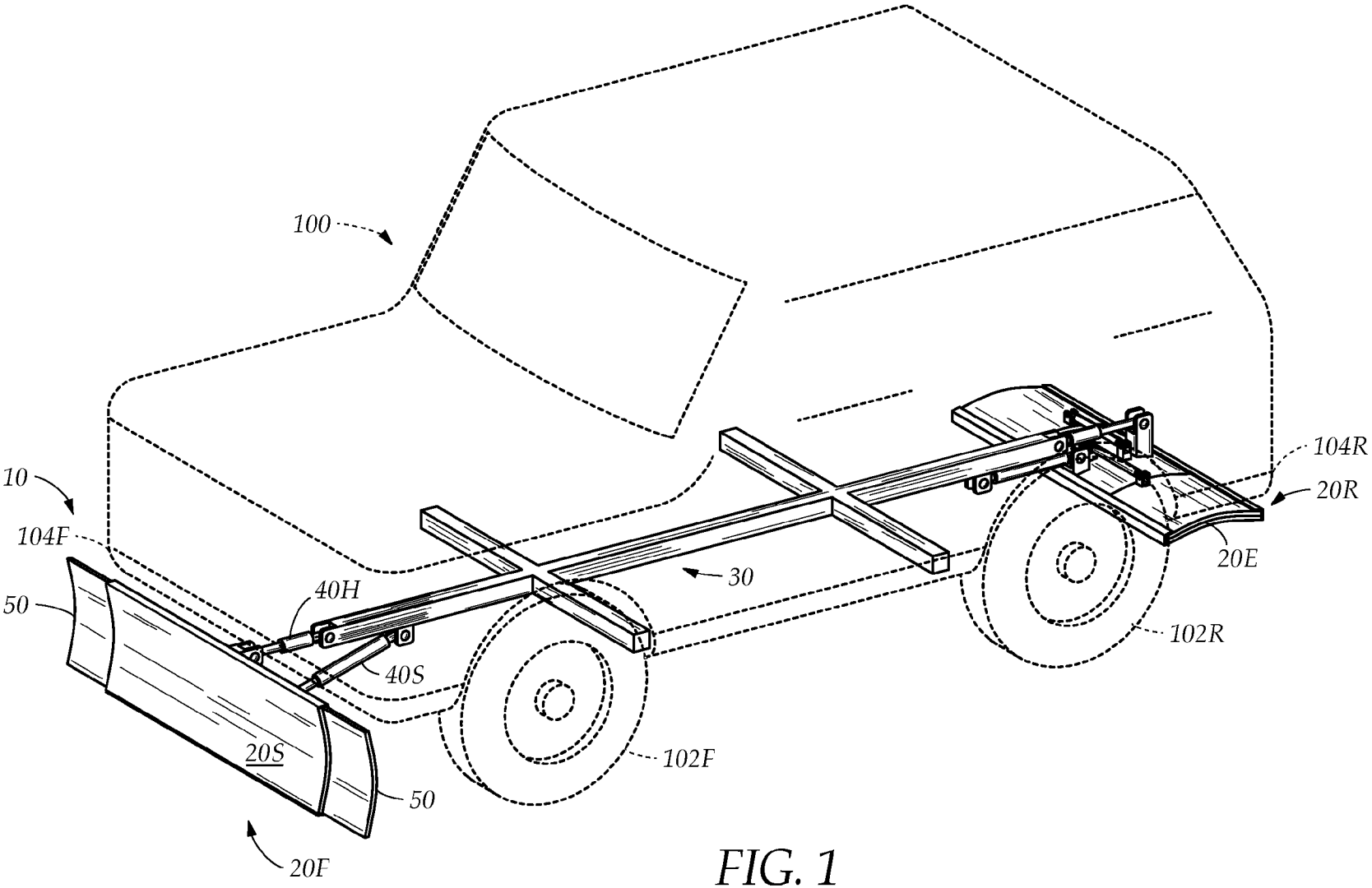
FIG. 1 is a diagrammatic perspective view of the invention attached to a sport utility vehicle (SUV), shown in outline, with a front blade deployed and a rear blade in a retracted position.

FIG. 1 illustrates a snow plow 10 having a front plow blade 20F and a rear plow blade 20R mounted on a frame assembly 30 underneath a vehicle 100 that selectively deploys to plow snow and selectively retracts when not in use. The plow blades are deployed and retracted by a mechanism that has a plurality of hydraulic cylinders 40H, 40S in a hydraulic cylinder assembly. The vehicle 100 has an underside, a front 100F having a pair of front wheels 102F and a front bumper 104F, and a rear 100R having a pair of rear wheels 102R and a rear bumper 104R. The plow blades 20F, 20R are disposed underneath the vehicle 100 when retracted in an essentially horizontal position. When deployed, the blades 20F, 20R advance towards the bumper 104F, 104R, passing beyond the bumper and tilting to an essentially vertical position, the blade positioned by the hydraulic cylinders 40H, 40S. The blades 20F, 20R, each having a pair of side edges 20E, have a plurality of extension panels 50 telescoping out from each side edge 20E, expanding the blades 20F, 20R, having a concave plowing surface 20S, the plowing surface increasing to remove snow in front of the wheels 102F, 102R to create a track wider than the vehicle.

Figure 3A:
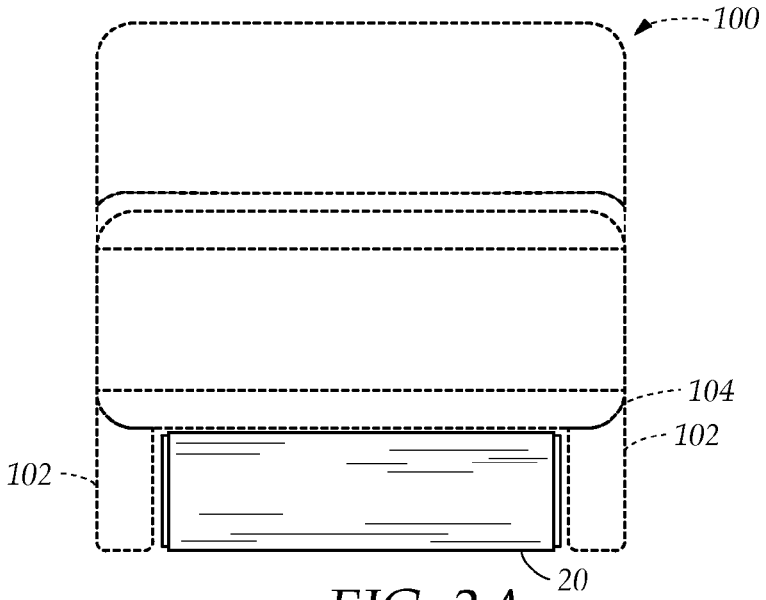
FIG. 3A is a front elevational view of the front blade deployed on the vehicle, with the vehicle in outline.
Figure 3B:
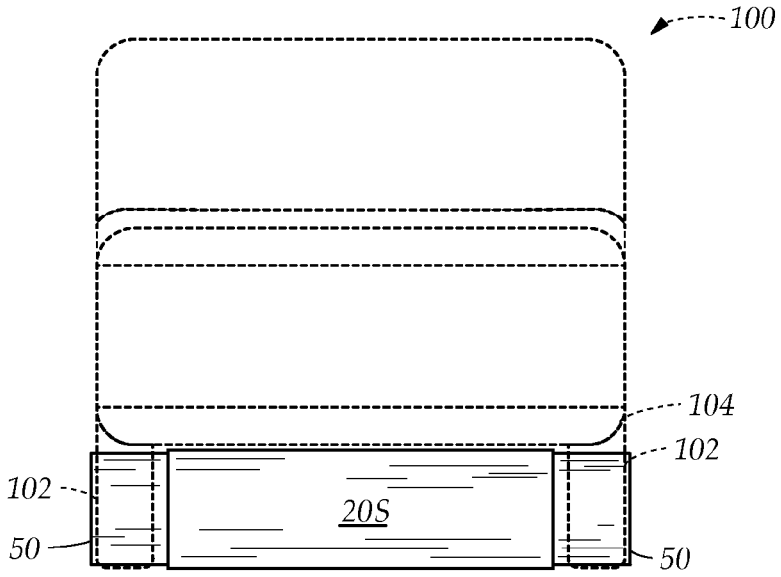
FIG. 3B, similar to FIG. 3A, is a front elevational view of the front blade deployed on the vehicle, shown in outline, with the blade expanded with a pair of extensions.

FIG. 3A shows the blade 20 deploying beyond the bumper in front of the pair of wheels 102, the pair of wheels 102 separated by a width. Initially the blade 20 is stored in the horizontal position under the vehicle 100. The blade 20, having a width, is pushed by hydraulic cylinders, passing beyond the bumper 104. Once the blade 20 advances beyond the bumper 104, the blade 20 pivots into a vertical position as shown in FIG. 3A. The width of the blade 20 with the extension panels 50 retracted is smaller than the length of the axle. The blade 20 advances beyond the bumper 104 of the vehicle 100 and pivots into the vertical position. FIG. 3B shows the blade 20, the blade deployed in the vertical position with the pair of side extension panel 50 expanded, one side extension 50 on each side of the blade 20, the side extensions increasing the plowing surface 20S so that a track wider than the width between the wheels is cleared by the plow.

Figure 5A:
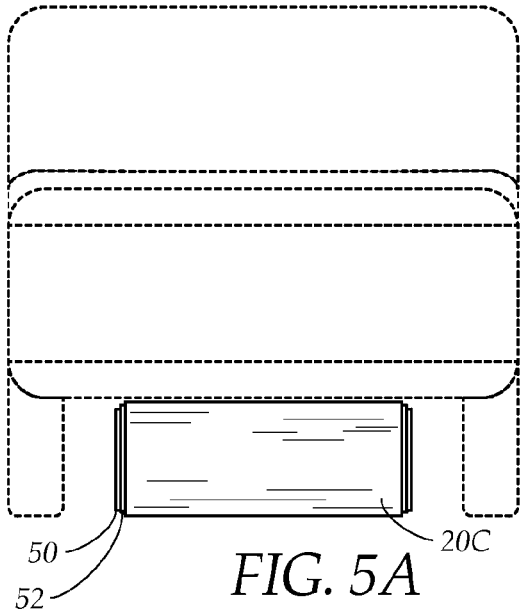
FIG. 5A is a front elevational view of the front plow blade deployed on the vehicle, shown in outline.
Figure 5B:
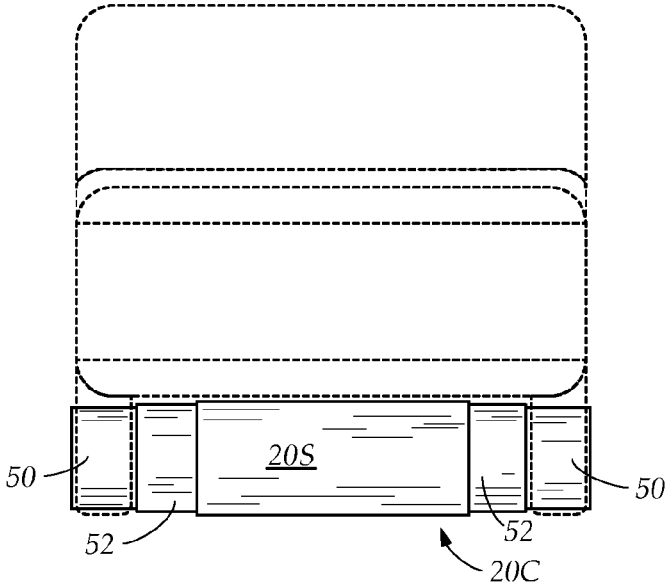
FIG. 5B, similar to FIG. 5A, is a front elevational view of the front blade deployed on the vehicle, with the vehicle in outline, with the plow blade expanded with a plurality of telescoping extensions.

FIG. 5A similarly shows a further example using a compact blade 20C, the compact blade 20C having an appreciably lesser width than the width between the wheels. The compact blade 20C has two pairs of side extension panels 50, 52. As demonstrated in FIG. 5B, when the blade 20C is deployed in the vertical position, the side extension panels 50, 52 telescopically expand, one pair on each side of the blade 20, the side extension panels 50, 52 increasing the plowing surface 20S so that a wider track wider is cleared by the plow.

Figure 2A:
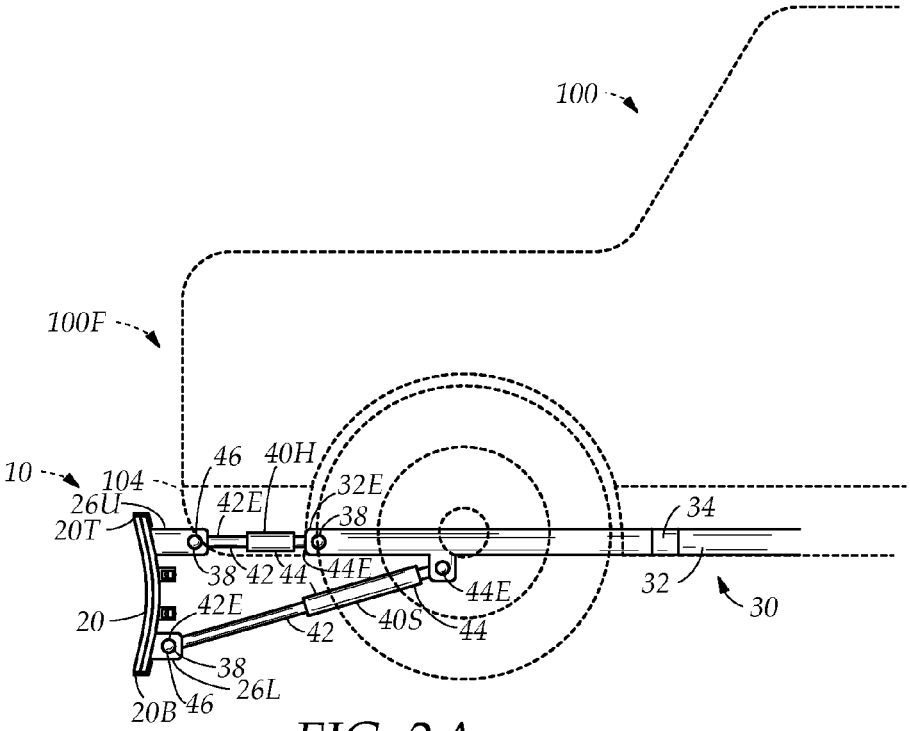
FIG. 2A is a side elevational view of the front blade deployed below a vehicle, shown in outline, by a hydraulic system.
Figure 2B:
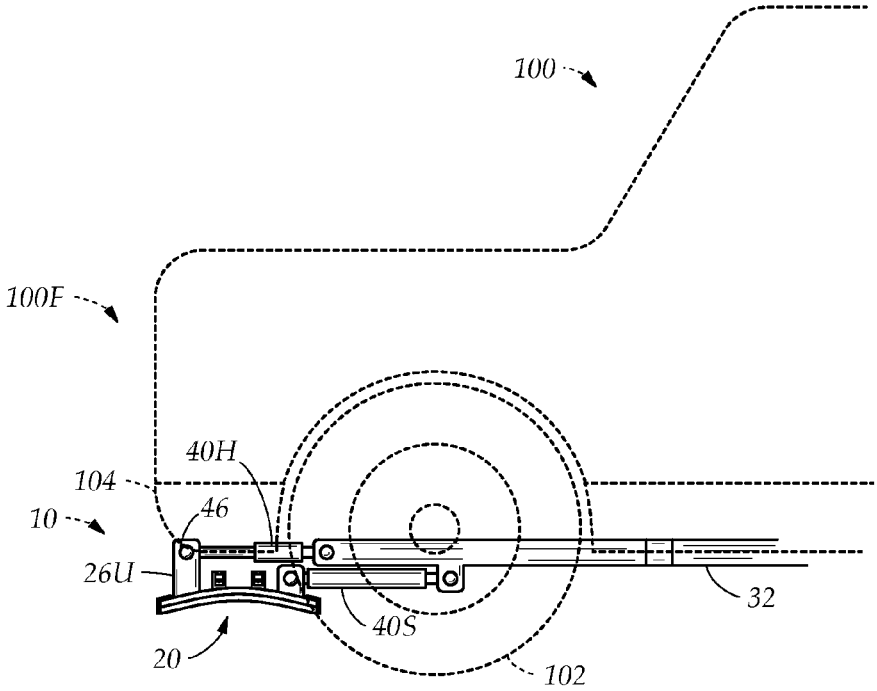
FIG. 2B, similar to FIG. 2A, is a side elevational view of the front blade retracted underneath the vehicle by the hydraulic system.

FIG. 2A shows the plow blade 20 in the vertical position, proximate to and beyond the bumper 104. The snow plow 10 has two blades 20, one in the front of the vehicle 100, one in the rear, each deploying and retracting in the same manner. For this discussion, FIG. 2A and FIG. 2B illustrate the vehicle front 10F, but it is understood that the rear blade operates analogously. The vehicle 100 depicted in the drawings is a typical sports utility vehicle (SUV), but the invention is not limited to installation on SUVs, and the snow plow is installable on other vehicles, such as, for example, vans, light pickup trucks, some sedans and other vehicles having sufficient ground clearance, all-wheel or four-wheel drive trains and an engine having sufficient power to push the snow plow through obstructions such as snow.

In FIG. 2A, the snow plow blade is attached by a pair of hydraulic cylinders 40H, 40S, a horizontal hydraulic cylinder 40H and a slanting hydraulic cylinder 40S, to the frame assembly 30 underneath the vehicle 100, the hydraulic cylinders each having a rod 42, a piston 44, and a pair of ends, a cap end 44E and a rod end 42E with a clevis 46. Hydraulic cylinders, how they are constructed, and how they function are well know to those of ordinary skill and are beyond the scope of this discussion. It is also understood the pneumatic cylinders can be constructed and modified to perform the same function as the hydraulic cylinders and are included within the inventive concept.

The frame assembly 30 has a center beam 32, parallel to the ground and at least one cross-strut 34 orthogonal to the center beam and parallel to the ground, the cross-strut 34 and center beam 32 attached underneath the vehicle 100. The beam has a pair of ends 32E, a first end at the front 100F of the vehicle and a second end at the rear. Attached to the end of the beam is a fixed joint 38, the joint connecting to the cap end 44E of the horizontal hydraulic cylinder 40H to the blade 20. The horizontal hydraulic cylinder 40H extends the plow horizontally, advancing from underneath the vehicle beyond the bumper and retracts the plow blade by retracting the plow blade back underneath the vehicle when the plow blade is in a horizontal position. The beam 32, having a bottom 32B, has a pivot joint 28 attached to the bottom 32B of the beam, connecting to the cap end 44E of the slanting hydraulic cylinder 40S. The slanting hydraulic cylinder 40S tilts the plow blade into a vertical position after the plow blade advances past the bumper when extending the plow blade and tilts the plow blade into a horizontal position prior to retracting the plow blade back under the vehicle The pivot joint 38 is set back a distance from the end 32E of the beam 32, the distance sufficient for the slanting hydraulic cylinder 40H to assume a horizontal position.

The blade 20, having a back, a center vertical axis, a top edge 20T and a bottom edge 20B, has a pair of short posts 26 disposed on the back along the center vertical axis, an upper post 26U adjacent to the top edge 20T and a shorter lower post 26L adjacent to the bottom edge 20B. The upper post 26U has a pivot joint 38 attached to the rod end 42E of the horizontal hydraulic cylinder 40H, the pivot joint 38 allowing the post 26U to partially rotate along a fixed vertical axis of rotation. The lower post 26L has a pivot joint 38 attached to the clevis 46 on the rod end 42E of the slanting hydraulic cylinder 40S.

FIG. 2A shows the plow blade 20 deployed, the hydraulic cylinders 40H, 40S fully extended, locking the blade 20 in a vertical position. When the blade 20 retracts, as shown in FIG.

2B, the horizontal cylinder 40H pulls the blade 20 away from front 100F of the vehicle. As the horizontal cylinder 40H retracts, the upper post 26U pivots in the clevis 46 so that as the slanting cylinder 40S retracts, the blade 20 moves into a horizontal position. When the plow blade 20 is fully retracted, the blade is horizontal and underneath the vehicle 100. In the drawing, the retracted blade 20 is shown slightly in front of the wheel 102, however, the blade 20 can be stored further aft of the wheels 102, the position depending on the relative length of the center beam 32 and the hydraulic cylinders 40H, 40S, a shorter center beam 32 and longer hydraulic cylinders 40H, 40S positioning the blade 20 further aft of the front 100F of the vehicle.

Figure 4A:
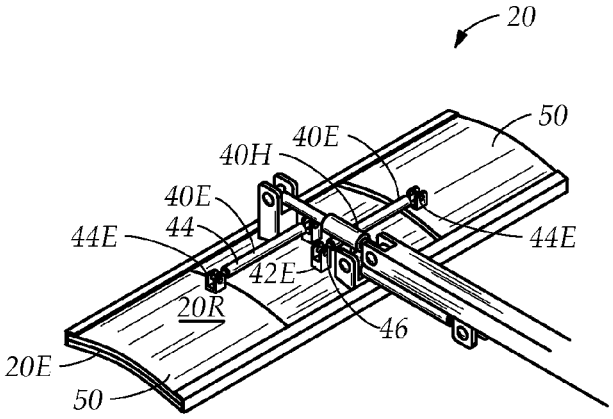
FIG. 4A is a diagrammatic perspective view of the plow blade, extensions and a hydraulic cylinder assembly in a retracted position.
Figure 4B:
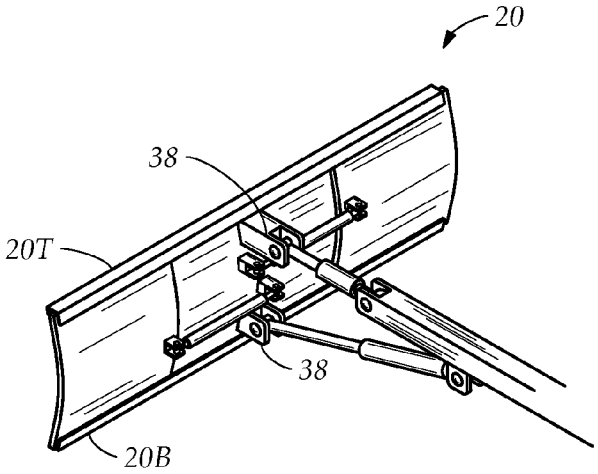
FIG. 4B, similar to FIG. 4A, is a diagrammatic perspective view of the blade and the hydraulic cylinder assembly in a deployed position and the extensions and extension hydraulic cylinders in a retracted position.
Figure 4C:
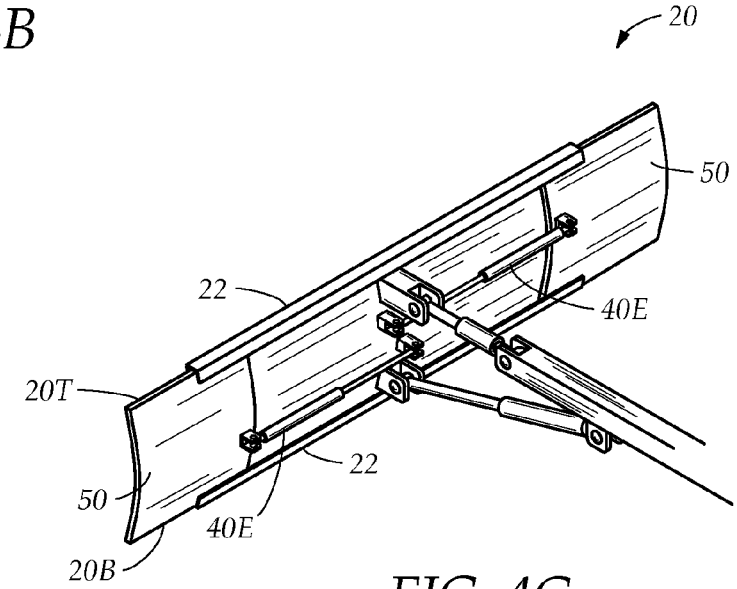
FIG. 4C, similar to FIG. 4A and FIG. 4B, is a diagrammatic perspective view of the plow blade and the hydraulic cylinder assembly in a deployed position and the extensions and extension hydraulic cylinders telescopically expanded in the deployed position.

FIG. 4A shows in detail a pair of extension hydraulic cylinders 40E, each having a rod 42, a piston 44, a cap end 44E and a rod end 42E with a clevis 46, on the back 20R of the blade 20. The extension hydraulic cylinders 40E telescopically extending the extension panels 50 out from the sides 20E of the plow blade 20 when the plow blade 20 is in a vertical position and retracting the extension panels 50 into the sides 20E of the plow blade 20 prior to retracting the plow blade 20 back under the vehicle. The extension hydraulic cylinders 40E are attached to the back 20R of the blade 20 toward the vertical center axis. In the drawing, the cap end 44E on the cylinder 40E is attached to the extension panel 50 and the clevis 46 on the rod end 42E is attached towards the center. It is understood by those of ordinary skill that reversing the orientation of the cylinder is not significant and that the invention functions the same whether the rod end 42E is attached on the back 20R center or on the extension 50. FIG. 4A shows the plow blade 20 in the horizontal position with the extension panels 50 contracted as the horizontal hydraulic cylinder 40H moves the blade 20 forward. FIG. 4B shows the blade 20 moving into the vertical position, with the slanting hydraulic cylinder 40S pushing the bottom of the blade 20B forward as the pivot joint 38 connecting the horizontal cylinder 40H rotates the blade 20. FIG. 4C shows the extension hydraulic cylinders 40E expanding the blade 20 by pushing the extension panels 50 out the sides 20E of the blade 20. At the top 20T and bottom edges 20B of the blade 20 are a pair of tracks 22. The panels 50 move within the tracks 22 as the cylinders 40E move the extension panels 50 outward, maintaining the extensions in alignment with blade 20.

Figure 6:
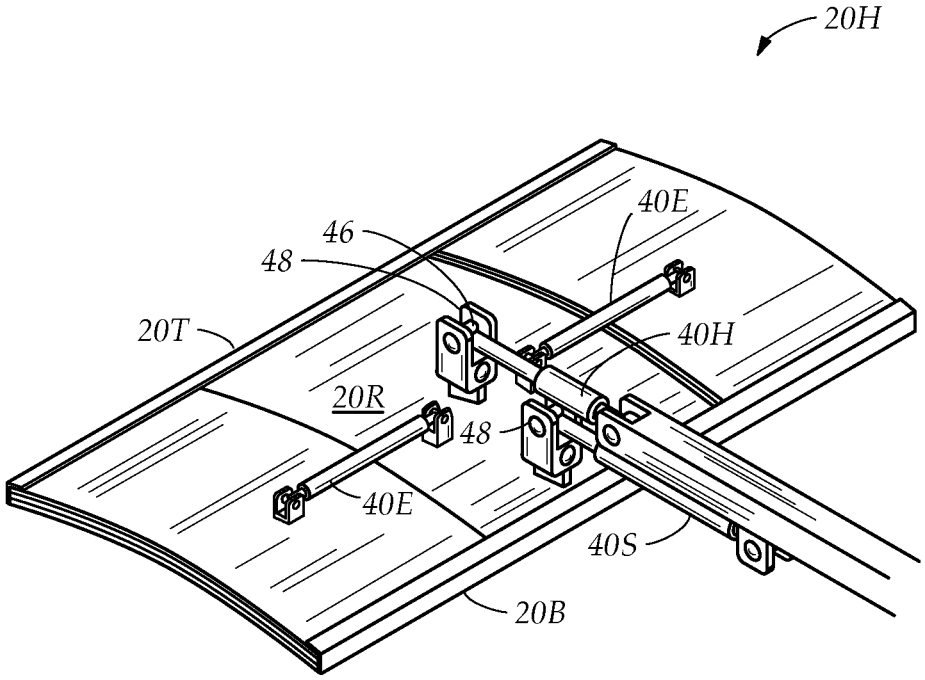
FIG. 6 is a diagrammatic perspective view of the blade with a pair of universal joints for pivoting, the extensions and hydraulic cylinder assembly in a retracted position.

FIG. 6 shows a further embodiment of the snow plow 10 employing a blade 20H. The taller blade 20H is more advantageous for plowing greater snow depths, providing the vehicle has a sufficiently powerful engine to drive the larger blade 20H. In this example, the clevis 46 on the horizontal hydraulic cylinder 40H and the clevis 46 on the slanting hydraulic cylinder 40S are connected to universal joints 48 on the vertical center axis. The joint 48 connecting the horizontal hydraulic cylinder 40H is midway between the top edge 20T and the bottom edge 20B of the blade 20, the blade 20H have a center horizontal axis, the joint 48 disposed along the center horizontal axis. In this embodiment, the universal joints 48 rotate the plow blade 20 to the right or to the left when the blade is in the vertical position so that the blade 20H attacks the snow at an angle, pushing the snow to the side rather than forward. The extension hydraulic cylinders 40E are attached to the back 20R of the blade 20 equidistantly from the center vertical axis along the center horizontal axis.

Figure 7:
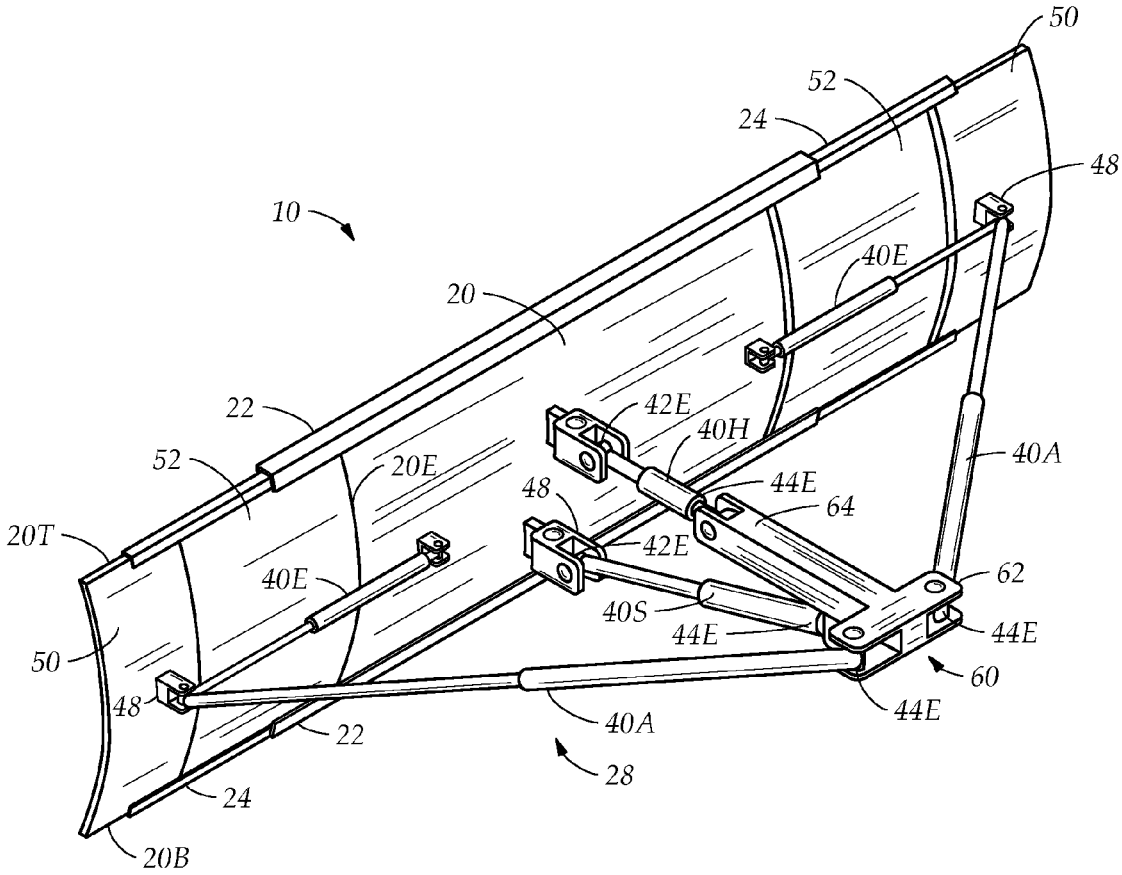
FIG. 7 is a diagrammatic perspective view of the deployed plow blade and a plurality of telescopic extensions.

FIG. 7 demonstrates another embodiment of the snow plow 10 with an articulated assembly 26 of hydraulic cylinders. The blade 20 has the pair of extension panels 50, 52 on each side 20E that telescopically expand to increase the surface of the blade 20. The rod end 42E of the horizontal hydraulic cylinder 40H and the rod end 42E of the slanting hydraulic cylinder 40S are connected to the back of blade 20R by the universal joints 48 described hereinabove. Each side 20E of the blade has a pair of extensions, the outer extension panel 50 and the inner extension panel 52. The panels 50, 52 telescope out, the outer panel 50 moving out from the inner panel 52. The rod end 42E of the extension hydraulic cylinders 40E are connected by a pivot joint 48 on the outer panel 50. Attached to the end of the beam, which is not shown, is a tee bracket 60. The tee bracket has a short cross piece 62 and a long stem 64. Attached to the long stem 64 is the cap end 44E of the horizontal hydraulic cylinder 40H, and attached to the cross piece 62 is the cap end 44E of the slanting hydraulic cylinder 40S and a pair of hydraulic cylinder arms 40A, each having a cap end 44E attached to the bracket 60. The pair of cylinder arms 40A extend to the outer extension panels 50, one arm 40A to each panel 50, connecting at a pivot joint 48 on the outer panel 50 where the extension hydraulic cylinders 40E connect to the outer panel 50. The tracks 22 at the top edge 20T and bottom edges 20B have a pair of telescoping tracks 24 that fit inside the tracks 22 and deploy with the panels 50, 52, expanding each track 22 to accommodate the extension panels. The extension panels 50, 52 move within the tracks 22 as the cylinders 40E move the extensions outward, keeping the extension panels 50, 52 aligned with blade 20. The cylinder arms 40A rotate the plow blade 20 to the right or to the left by selectively expanding and contracting in opposing motions, so that the blade 20 attacks the snow at an angle, pushing the snow to the side rather than forward. When the rod on one arm 40A contracts, the blade 20 slants in the direction of the contracting arm. The universal joints 48 on the horizontal hydraulic cylinder 40H and slanting hydraulic cylinder 40S rotate the blade 20 in conjunction with the hydraulic cylinder arms 40A. The hydraulic arms 40A rotate the plow blade 20 in the right or left direction, by a first hydraulic arm retracting in the direction of rotation and a second hydraulic arm extending in the opposing direction, stably positioning the blade at an angle to attack the snow.

Figure 8A:
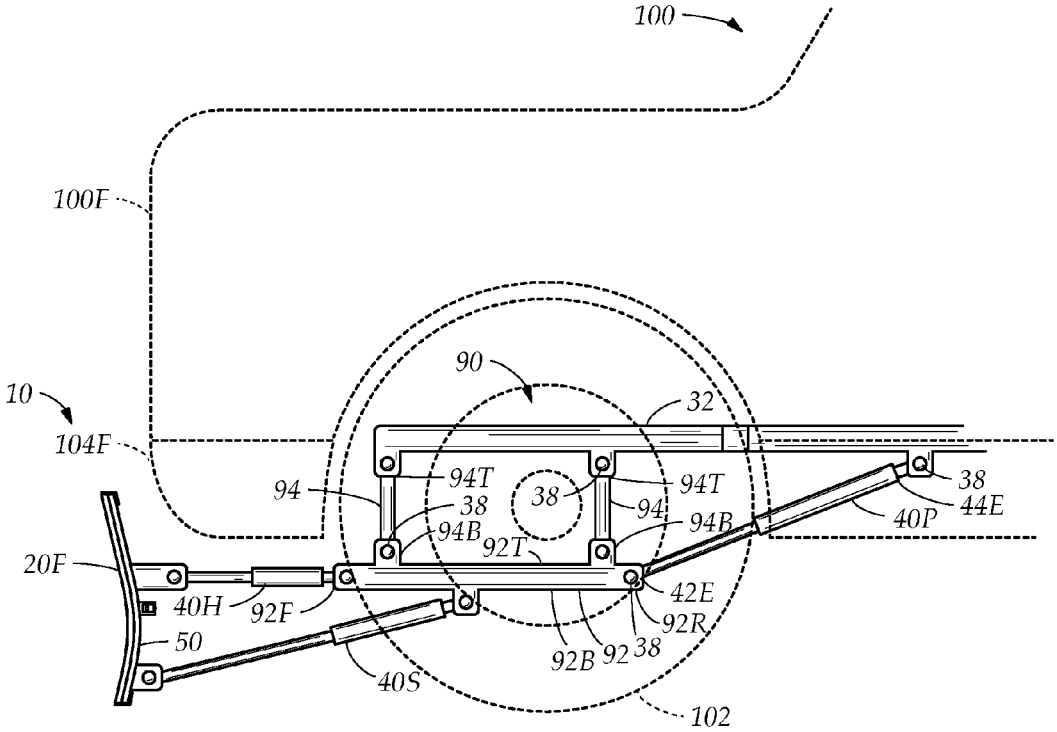
FIG. 8A is a side elevational view of the plow blade with a pantographic frame assembly in the deployed position, with the vehicle in outline.
Figure 8B:
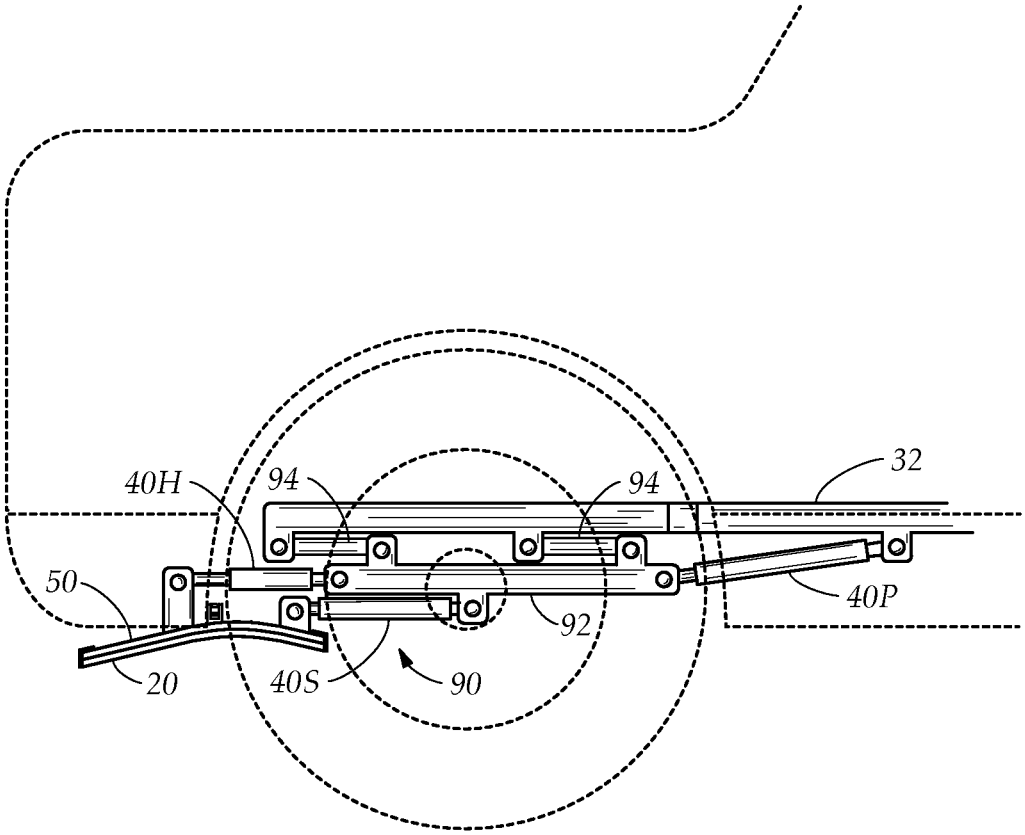
FIG. 8B, similar to FIG. 8A, is a side elevational view of the plow blade with the pantographic frame assembly in the retracted position with the vehicle in outline.

FIG. 8A and FIG. 8B illustrate yet a further embodiment of the snow plow 10 with a pantographic frame portion 90 that retracts the snow plow blade 20 and hydraulic cylinders 40H, 40S higher and further aft of the front 100F of the vehicle, the blade 20 invisible behind the bumper 104F. Referring to FIG. 8A, the pantographic frame portion 90 has a rack 92, a pantographic hydraulic cylinder 40P, and a pair of pivoting supports 94 attached to the beam 32, connecting the beam 32 to the rack 92. Each support 94 has a pair of ends, a top end 94T and a bottom end 94B, the top ends 94T connecting to the beam 32 by pivot joints 38 and the bottom ends 92B connecting to the rack 92 by pivot joints 38, the pivot joints 38 allowing the supports 94 to swivel within a limited range of rotation. The rack 92 has a top 92T, a bottom 92B and a pair of ends, a fore end 92F and an aft end 92R. Connecting to the rack 92 at the fore end 92F is the horizontal hydraulic cylinder 40H. The slanting hydraulic cylinder 40S connects to the bottom 92B of the rack 92, off set towards the aft end 92R at a distance from the fore end 92F of the rack 92 at the distance sufficient for the slanting hydraulic cylinder 40S to assume a horizontal position under the rack 92. The slanting hydraulic cylinder 40S and horizontal hydraulic cylinder 40H connects to the blade as described hereinabove.

Attached to the aft end 92R of the rack 92 is the pantograph hydraulic cylinder 40P, having a rod end 42E and a cap end 44E, the rod end 42E connecting to the aft end 44E with a pivot joint 38. The cap end 44E connects to the beam 32 by a pivot joint 38, the pivot joint 38 further aft than the supports 94, at a distance sufficient for the pantograph hydraulic cylinder 40P to assume a horizontal position under the beam 32 when the snow plow blade 20 is retracted as illustrated in FIG. 8B.

Referring to FIG. 8A, when the blade 20 is deployed, the pantograph hydraulic cylinder 40P pushes the rack 92 to the front 100F of the vehicle. When the rack 92 moves forward, the supports 94 pivot into a vertical position, lowering the rack 92 sufficiently, so that the rack 92 and the attached horizontal hydraulic cylinder 40H move under the bumper 104F. The horizontal hydraulic cylinder 40H and the slanting hydraulic cylinder 40E move the plow blade 20 forward to the front 100F of the vehicle and into the vertical position as described hereinabove. Referring to FIG. 8B, when the plow blade 20 is retracted, the pantograph hydraulic cylinder contracts 40P and pulls the rack 92 upward toward the beam 32 until the pantograph hydraulic cylinder 40P is almost horizontal with the beam 32, the supports 94 pivoting into a horizontal position under the beam 32, pulling the rack 92 up and under the supports 94. The pantographic frame portion 90 fits compactly under the beam 32, invisible from outside the vehicle 100. The horizontal hydraulic cylinder 40H and the slanting hydraulic cylinder 40S retract the blade 20 into the horizontal position as described hereinabove.

FIG. 8A and FIG. 8B illustrate the pantographic frame assembly 90 with the blade 20 having one pair of extensions 50, one on each side of the blade 20, the extensions without the hydraulic arm for the sake of simplicity and clarity. It is understood by one of ordinary skill that the pantographic frame assembly is useful with other embodiments such as the blade having telescoping panel extensions and hydraulic arms.

Referring to FIG. 1, to use the snow plow 10, a driver selectively deploys the plow blade 20 when the vehicle is about to move forward, the front plow blade 20F in this illustration, by initiating the horizontal hydraulic cylinder 40H and the slanting hydraulic cylinder 40S to extend, the hydraulic cylinders 40H, 40S advancing the blade 20 towards the bumper 104, passing beyond the bumper 104 and tilting the blade 20 to an essentially vertical position. The driver initiates the extension hydraulic cylinders to expand the extensions 50 on the blade 20. When the driver chooses to stop plowing, the driver selectively retracts the plow blade 20 by contracting the extension hydraulic cylinders, pulling the extensions 50 toward the center of the blade 20, further contracting the horizontal hydraulic cylinder 40H and the slanting hydraulic cylinder 40S, the slanting hydraulic cylinder 40S swiveling the blade 20 into the horizontal position, the hydraulic cylinders 40H, 40S retracting the blade 20 away from the bumper 104F, passing under the bumper 104F into the position underneath the vehicle 100. When the driver chooses to move backward in the reverse direction, the driver selectively retracts the first plow blade, the front plow blade 20F as illustrated, as described hereinabove and selectively deploys the rear plow blade 20R before the vehicle is about to move backward as described hereinabove. When the vehicle is about to move forward again, the driver selectively retracts the rear plow blade as described hereinabove.

Referring to FIG. 7, to use the snow plow having the articulated assembly 26 of hydraulic cylinders, a driver selectively engages the plow blade 30 by initiating the horizontal hydraulic cylinder 40H and the slanting hydraulic cylinder 40S as described hereinabove. The driver initiates the extension hydraulic cylinders 40E and the hydraulic arms 40A to expand the extension panels 50, 52 on the blade 20. The driver selectively swivels the blade 20 to the right or the left to attack the snow at an angle, by retracting the hydraulic arm 40A of the desired direction, pulling the extension 50 toward the vehicle allowing the hydraulic arm 20A on the opposing side to expand, forcing the opposing extension 50 in the opposite direction, swiveling the blade 20 toward the retracted arm 40A. When the driver chooses to stop plowing, the driver selectively retracts the plow blade 20 by contracting the extension hydraulic cylinders 20E and the hydraulic arms 20A, pulling the extension panels 50, 52 toward the center of the blade 20, further contracting the horizontal hydraulic cylinder 40H and the slanting hydraulic cylinder 40S, the slanting hydraulic cylinder 40S swiveling the blade 20 into the horizontal position, the hydraulic cylinders 40H, 40S retracting the blade 20F away from the bumper, passing under the bumper 104F and moving further underneath the vehicle 100. When the driver choose to reverse direction, the driver selectively retracts the first plow blade, the front plow blade 20F as illustrated, as described hereinabove and selectively deploys the second rear plow blade as described hereinabove.

Referring to FIG. 8A, to use the snow plow having the pantographic frame assembly 90, a driver selectively engages the plow blade 30 by initiating the pantograph hydraulic cylinder 40P to lower the rack 92 below the level of the bumper 104F by swiveling the supports 94 into the vertical position, moving the rack 92 down and forward. The driver further initiates the horizontal hydraulic cylinder 40H and the slanting hydraulic cylinder 40S as described hereinabove. The driver initiates the extension hydraulic cylinders 40E to expand the extensions 50 on the blade 20. When the driver chooses to stop plowing, the driver selectively retracts the plow blade 20 by contracting the extension hydraulic cylinders 20E, pulling the extensions 50 toward the center of the blade 20F, further contracting the horizontal hydraulic cylinder 40H and the slanting hydraulic cylinder 40S, the slanting hydraulic cylinder 40S swiveling the blade 20 into the horizontal position, the hydraulic cylinders 40H, 40S retracting the blade 20F away from the bumper, passing under the bumper 104F, the pantograph hydraulic cylinder 40P retracting the rack 92 backwards pulling the blade 20 further underneath the vehicle 100. When the driver choose to reverse direction, the driver selectively retracts the first plow blade, the front plow blade 20F as illustrated, as described hereinabove and selectively deploys the second rear plow blade as described hereinabove.

In conclusion, herein is presented a snow plow having a front and rear blade attached and stored underneath a vehicle that selectively deploys when needed to plow and remove snow. The invention is illustrated by example in the drawing figures, and throughout the written description. It should be understood that numerous variations are possible, while adhering to the inventive concept. Such variations are contemplated as being a part of the present invention.

What is claimed is:

1. A snow plow for plowing snow, the snow plow for permanently attaching to a vehicle having a front bumper and a rear bumper, comprising:

a frame assembly, the frame assembly having a beam with a bottom, a pair of ends and a top, the top attaching underneath the vehicle;

a pair of plow blades that selectively extend to deploy for snow plowing and retract underneath the vehicle when not in use, a front plow blade and a rear plow blade, the plow blades each having a back and a pair of sides, each side having at least one extension panel, the front plow blade disposed horizontally underneath the vehicle and disposed vertically in front of the front bumper when extended, the rear plow blade disposed horizontally underneath the vehicle when retracted and disposed vertically behind the rear bumper when extended; and a plurality of hydraulic cylinders selectively extending and retracting the plow blades and extensions, a horizontal hydraulic cylinder attached to the beam end and to the back of the plow blade, the horizontal hydraulic cylinder extending the plow blade horizontally, advancing from underneath the vehicle beyond the bumper to deploy the plow blade and retracting the plow blade back underneath the vehicle when the plow blade is in a horizontal position, a slanting hydraulic cylinder attached to the bottom of the beam and to the back of the plow blade, the slanting hydraulic cylinder tilting the plow blade into a vertical position after the plow blade advances beyond the bumper when deploying the plow blade and tilting the plow blade into a horizontal position prior to retracting the plow blade back underneath the vehicle and a pair of extension hydraulic cylinders, each having a pair of ends, a first end attached to the back of the plow blade and a second end attached to an extension panel, the extension hydraulic cylinders telescopically extending the extension panels out from the sides of the plow blade when the plow blade is deployed in a vertical position and retracting the extension panels into the sides of the plow blade prior to retracting the plow blade back underneath the vehicle.

2. The snow plow as described in claim 1, wherein the front plow blade selectively deploys when the vehicle is about to move forward and selectively retracts when the vehicle is about to move backward and the rear plow blade selectively deploys when the vehicle is about to move backward and selectively retracts when the vehicle is about to move forward.

3. The snow plow as described in claim 2, wherein the horizontal hydraulic cylinder and the slanting hydraulic cylinder are each attached to the back of the plow blade by a universal joint such that the plow blade rotates in a right direction or in a left direction to plow the snow at an angle.

4. The snow plow as described in claim 3, wherein the plow blade has a pair of hydraulic arms each having a pair of ends, a hydraulic arm on each side of the plow blade, each hydraulic arm having a first end attached to the extension panel on the same side of the plow blade and a second end attached to the frame assembly, the hydraulic arms further stably rotating the plow blade in the right or left direction, by a first hydraulic arm retracting in the direction of rotation and a second hydraulic arm extending in the opposing direction to plow the snow at an angle.

5. The snow plow as described in claim 4, wherein the plow blade has a pair of extension panels on each side of the plow blade, an inner panel and an outer panel that are telescopically extended and retracted by the extension hydraulic cylinders attached to the outer panels.

6. The snow plow as described in claim 5, wherein the plow blade has a pair of telescoping tracks, a first track on top of the plow blade and a second track on the bottom of the plow blade, the extension panels moving inside the tracks, the tracks maintaining the extension panels in alignment with the plow blade.

7. The snow plow as described in claim 6, wherein the plow blade has a front, the front having a concave surface for plowing.

8. The snow plow as described in claim 7, wherein the frame assembly has a pantographic frame portion attached to the bottom of the beam, the pantographic frame portion having a rack, a pair of supports, each support having a pair of ends with pivoting joints, and a pantographic hydraulic cylinder having a pair of ends, a first end attached to the bottom of the beam and a second end attached to the rack, the pivoting joints on the supports further connecting the rack to the beam, the pivoting joints extending from the beam to the rack, the horizontal hydraulic cylinder and the slanting hydraulic cylinder attaching the rack to the plow blade so that when the plow blade is selectively deployed, the pantographic hydraulic cylinder moves the rack down, the supports pivoting into a vertical position lowering the rack with the horizontal hydraulic cylinder and the slanting hydraulic cylinder, thereby moving the plow blade closer to the ground and when the plow blade is selectively retracted, the pantographic hydraulic cylinder retracts the rack upward, the supports pivoting into a horizontal position, the horizontal hydraulic cylinder and the slanting hydraulic cylinder thereby retracting the plow blade into a position further from the ground underneath the vehicle.

9. A snow plow for plowing snow, the snow plow attached to a vehicle having an underside and a pair of bumpers, comprising:

a frame assembly attaching underneath the vehicle;

a pair of plow blades, namely a front plow blade and a rear plow blade; and a mechanism that connects the plow blades to the frame, for selectively extending the plow blades beyond the bumpers in a substantially vertical position for plowing snow, and for selectively retracting the plow blades underneath the vehicle in a substantially horizontal position for storage when not in use, the front plow blade disposed horizontally underneath the vehicle when retracted and disposed vertically in front of the front bumper when extended, the rear plow blade disposed horizontally underneath the vehicle when retracted and disposed vertically behind the rear bumper when extended.

10. The snow plow as described in claim 9, wherein the front plow blade selectively deploys when the vehicle is about to move forward and selectively retracts when the vehicle is about to move backward and the rear plow blade selectively deploys when the vehicle is about to move backward and selectively retracts when the vehicle is about to move forward.

11. The snow plow as described in claim 10, wherein the mechanism that connects at least one plow blade to the frame, for selectively extending and retracting the plow blade is a plurality of hydraulic cylinders selectively extending and retracting the plow blade, a horizontal hydraulic cylinder attached to the frame assembly and to the plow blade, the horizontal hydraulic cylinder extending the plow blade horizontally, advancing from underneath the vehicle beyond the bumper to deploy the plow blade and retracting the plow blade back underneath the vehicle when the plow blade is in a horizontal position, a slanting hydraulic cylinder attached to the frame assembly and to the plow blade, the slanting hydraulic cylinder tilting the plow blade into a vertical position after the plow blade advances beyond the bumper when deploying the plow blade and tilting the plow blade into a horizontal position prior to retracting the plow blade back underneath the vehicle and a pair of extension hydraulic cylinders.

12. The snow plow as described in claim 10, wherein the plow blade has a back and the horizontal hydraulic cylinder and the slanting hydraulic cylinder are each attached to the back of the plow blade by a universal joint such that the plow blade rotates in a right direction or in a left direction to plow the snow at an angle.

13. The snow plow as described in claim 12, wherein the plow blade has a pair of sides, each side having at least one extension panel that extends out the side by an extension hydraulic cylinder, having a pair of ends, a first end attached to the back of the plow blade and a second end attached to the extension panel, the extension hydraulic cylinder telescopically extending the extension panel out from the sides of the plow blade when the plow blade is deployed in a vertical position and retracting the extension panels into the sides of the plow blade prior to retracting the plow blade back underneath the vehicle.

14. The snow plow as described in claim 13, wherein the plow blade has a pair of hydraulic arms each having a pair of ends, a hydraulic arm on each side of the plow blade, each hydraulic arm having a first end attached to the extension panel on the same side of the plow blade and a second end attached to the frame assembly, the hydraulic arms further stably rotating the plow blade in the right or left direction, by a first hydraulic arm retracting in the direction of rotation and a second hydraulic arm extending in the opposing direction to plow the snow at an angle.

15. The snow plow as described in claim 14, wherein the plow blade has a pair of extension panels on each side of the plow blade, an inner panel and an outer panel that are telescopically extended and retracted by the extension hydraulic cylinders attached to the outer panels.

16. The snow plow as described in claim 14, wherein the plow blade has a pair of telescoping tracks, a first track on top of the plow blade and a second track on the bottom of the plow blade, the extension panels moving inside the tracks, the tracks maintaining the extension panels in alignment with the plow blade.

17. The snow plow as described in claim 15, wherein the plow blade has a front, the front having a concave surface for plowing.

18. The snow plow as described in claim 17, wherein the frame assembly has a pantographic frame portion attached to the bottom of the beam, the pantographic frame portion having a rack, a pair of supports, each support having a pair of ends with pivoting joints, and a pantographic hydraulic cylinder having a pair of ends, a first end attached to the bottom of the beam and a second end attached to the rack, the pivoting joints on the supports further connecting the rack to the beam, the pivoting joints extending from the beam to the rack, the horizontal hydraulic cylinder and the slanting hydraulic cylinder attaching the rack to the plow blade so that when the plow blade is selectively deployed, the pantographic hydraulic cylinder moves the rack down, the supports pivoting into a vertical position lowering the rack with the horizontal hydraulic cylinder and the slanting hydraulic cylinder, thereby moving the plow blade closer to the ground and when the plow blade is selectively retracted, the pantographic hydraulic cylinder retracts the rack upward, the supports pivoting into a horizontal position, the horizontal hydraulic cylinder and the slanting hydraulic cylinder thereby retracting the plow blade into a position further from the ground underneath the vehicle.

* * * * *